United States Patent [19]

Dell

[11] 4,190,235

[45] Feb. 26, 1980

[54] FLUIDIZED BED LADLE HEATING METHOD AND APPARATUS

[76] Inventor: William C. Dell, 1211 Connecticut Ave., NW., Washington, D.C. 20036

[21] Appl. No.: 942,366

[22] Filed: Sep. 14, 1978

Related U.S. Application Data

[63] Continuation-in-part of Ser. No. 933,834, Aug. 15, 1978, abandoned.

[51] Int. Cl.[2] ..... C21D 1/00

[52] U.S. Cl. ..... 266/44; 148/16; 148/20.3; 148/155; 164/121; 266/249; 266/281; 266/287

[58] Field of Search ..... 266/44, 172, 249, 251, 266/252, 257, 281, 287, 901; 164/121; 148/14, 16, 20.3, 155, 156

[56] References Cited

U.S. PATENT DOCUMENTS 4,106,755 8/1978 Dell ..... 266/44

*Primary Examiner*—R. Dean

*Attorney, Agent, or Firm*—J. Gibson Semmes

[57] ABSTRACT

Method and apparatus defining a combustion and fluidized heating system for the heating of ladles of the type commonly used in the foundry and steel industry is described whereby fluidized-bed technology is employed to achieve greatly improved fuel efficiency. In the method, the particles forming the substance of the bed are placed directly into the ladle. The same may be drawn from a prior heated ladle. In practice, the initial heating medium be it gas or liquid or solid or electric may be replaced in final heating by the direct introduction into the bed of solid or fluid fuel to achieve combustion within the bed itself. Alternatively the bed may be heated electrically as by immersion of an electric resistance heater in the bed. Control of the combustion and the fluidizing medium is inherent in operative characteristics of the invention.

36 Claims, 3 Drawing Figures

FLUIDIZED BED LADLE HEATING METHOD AND APPARATUS

BACKGROUND OF THE INVENTION

This application is a Continuation-In-Part of application Ser. No. 933,834 filed Aug. 15, 1978, abandoned entitled FLUIDIZED BED LADLE HEATING METHOD AND APPARATUS and is related to U.S. Pat. No. 4,106,755, issued Aug. 15, 1978.

Among the significant users of fuel in the U.S. economy are the foundry and steel mills. In operating these mills, natural gas is customarily used both for ladle drying and pre-heating, in addition to other tasks. Gas as the only fuel has primarily been used in these industries for the past two decades because it has been low in cost and it has offered simplicity of operation, with minimum pollution control requirements. Nonetheless, drying and preheating of ladles is less than 10 percent efficient in the use of such high quality fuels. Due to the recent energy crisis and the decline in natural gas reserves in the U.S., it has become apparent that many of these industries will have to forego the use of gas as the primary fuel, for other fuels and employ more efficient processes.

The most plentiful alternative fuel in the United States today is coal. Coal comes in many varieties ranging from high volatile-high sulfur content to low volatile-low sulfur content coal all with a variety of ash content. Because of the nature of the fuel, several environmental problems may be encountered in applying it to foundries and steel mill operations. The principal problems are the gaseous emissions primarily found in the form of sulfur oxides and particulate emissions formed from the ask content of the coal.

The present invention addresses the problem of inefficient use of gas and/or liquid fuels, while at the same time allowing the substitution of a less expensive, particulate fuel to enhance a given ladle heating process. It is, for example, within the ambit of invention to optionally employ electricity in the pre-heating of the fluidized bed as will be more fully explained hereafter. Also within the process it is an objective to transfer the hot fluidizing media such as sand to a ladle to be preheated from one which has just been preheated.

The present invention herein is conceived to achieve minimum environmental impact, while allowing the use of coals other fuels and even electricity for several tasks in foundries and steel mills. The principal task herein comprises the preheating of ladles. These ladles are large steel bucket-like containers with refractory liners into which molten steel is poured, generally from electric arc or other type of furnaces. In order to minimize the cooling of the molten steel or other metals so that further pouring operations can be conducted, it is necessary to preheat the ladle to such temperature, viz 1600° F.–1800° F. that little, if any, heat is lost from the molten steel into the ladle. As indicated above, the preheating operation is presently performed primarily with natural gas or oil and it is thus proposed that this task be modified so as to obtain greatly improved efficiencies with a secondary capability of using solid and/or fluid and/or combination thereof with combustion taking place within the ladle itself. Heating under this secondary capability may encompass electrical pre-heating of the bed by immersion of such electrical apparatus directly into the bed for coactive operation with the fluidizing means.

Among gas-fired ladle heaters are the Burnham blue flame industrial burner. It is currently used, for example in the preheating of ladles of the Shah-Milwaukee Steel Division, Grede's Foundries, Inc. In such instances, the pour ladle is disposed horizontally, relative to the industrial wall burner, the refractory burner block having an appropriate hot gas return tube. These prior art gas-fired ladle heaters operate at approximately 1800° F., although they may be operated at either high or low fire.

Foundry or mill ladle drying and preheating, and ladle-heating efficiency has also been made the subject of a group research proposal entitled Development of Lower-Cost Ladle-Heating Practices by the Battelle Columbus Laboratories as of Mar. 31, 1976; Proposal No. 926-8-3952. In none of the prior art has direct fluidization in the ladle been undertaken to affect a preheating thereof. Such is the nature of this invention by which one may obtain high thermal efficiency, uniform heating of the ladle, shortened operational periods to preheat, maximum waste heat recovery. Engineering thermaldynamic calculations predict increased fuel efficiency of 81% over that which is obtained in the practice of the prior art.

In the design-tion of fuels, the term "fluid" shall be construed to mean liquid or gas; examples: oil and/or natural gas.

The term "high temperature" herein shall designate those temperatures which fall within the range of 1000° F. to 2000° F., as opposed to those which are less than 1000° F.

FBLHS herein shall designate: fluid bed ladle heating system.

DESCRIPTION OF THE PREFERRED EMBODIMENTS

The present invention employing a fluidized heat transfer medium may be embodied in several modes, depending on the needs of a specific application, a preferred embodiment is shown in the accompanying drawings.

Figure 2:
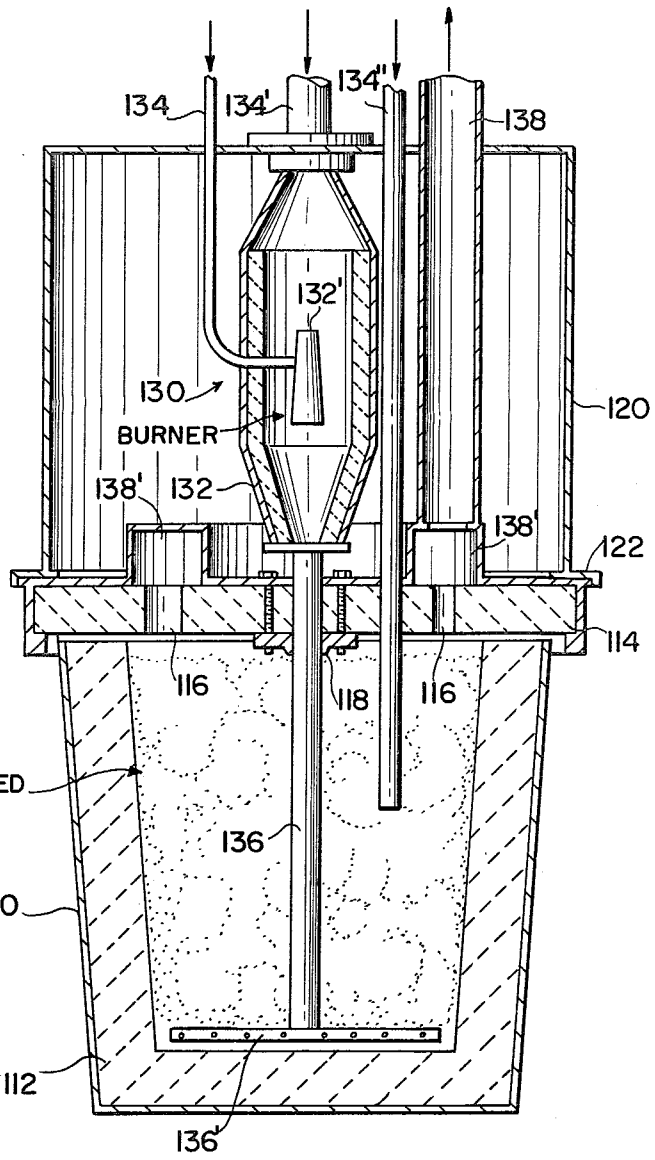
FIG. 2 is an enlarged sectional view, taken along lines 2—2 of FIG. 1, of ladle and bonnet adapter interconnecting the ladle under treatment with fuel supply and combustion product exhaust.
Figure 1:
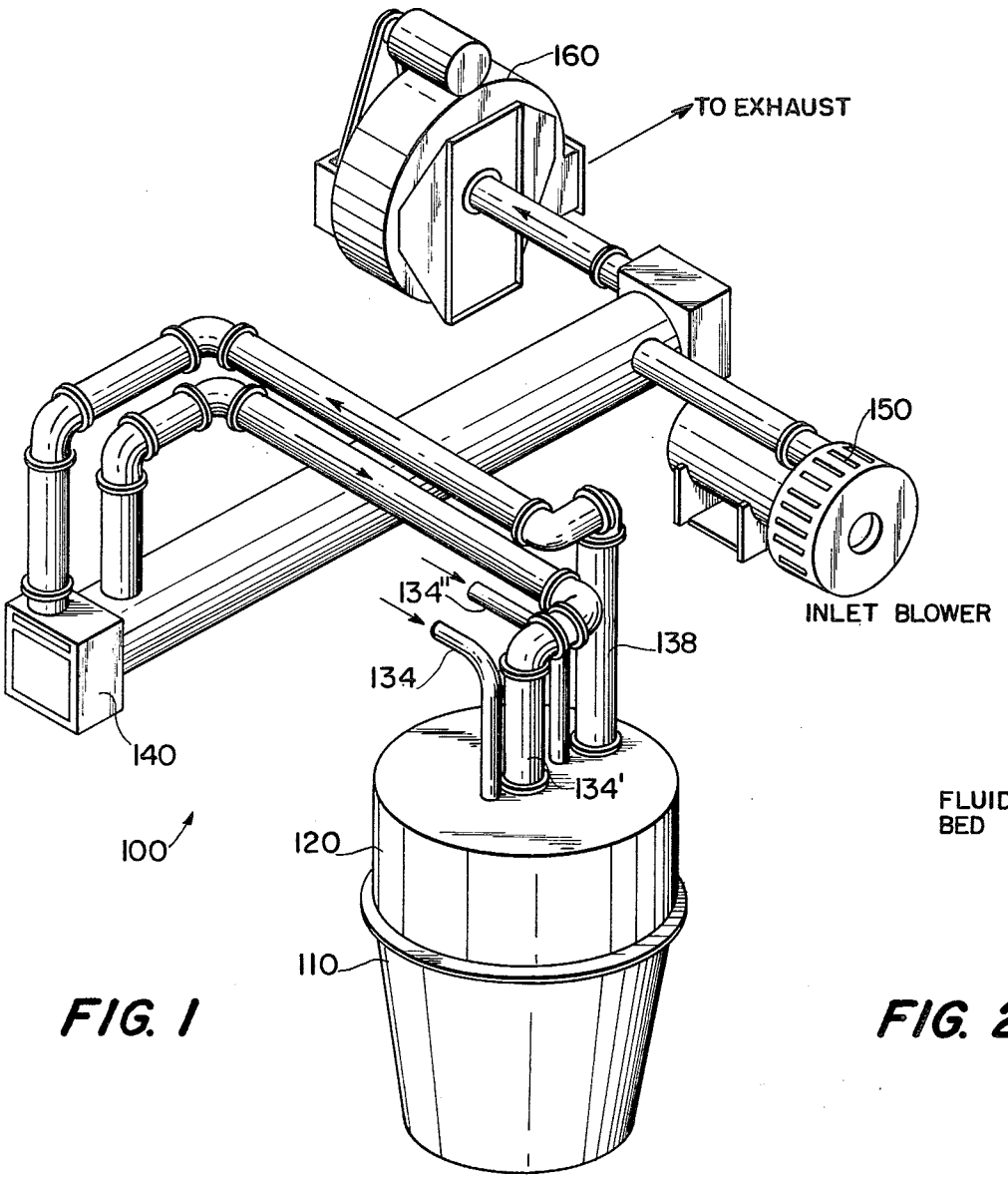
FIG. 1 is a view in perspective of apparatus in accordance with the invention.

Referring to FIGS. 1 and 2, the fluid-bed ladle heating unit 100 comprises in complement a foundry or mill ladle 110, refractory lines as at 112, the ladle having a conventional pouring outlet and being adapted, for the purposes of the invention to sustain, during the ladle preheating operation a fluidized-bed therein and to removeably support, for the term of the preheating a bonnet or cover 120. Resting atop the ladle 110 and forming a part of the cover 120 is a refractory spacer cap 114, appropriately apertured at 116 as well as at 118 to accommodate operationally input gases of combustion and output gases thereof. It will be noted that a small gap exists between respective refractories 112 and 114, this gap enabling a minute influx of air which is due to a small negative pressure in the upper portion of the fluidized-bed, adjacent to the top of the ladle. This prevents the escape of fluidized samd and/or gases of combustion as will be more fully explained hereinafter. This gap may be sustained either by the support of the distribution plate 136' from the burner resting upon the bottom of the liner of the ladle or from irregularities in the opposed surfaces of the refractory elements 112—112.

The burner system 130, within the cover 120 includes a combustion chamber 132, appropriately lined with refractory and having therein a burner 132' supplied by the fuel inlet 134 and preheated air inlet 132'. This preheated air becomes a vital adjunct to maintain the fluidization of the bed throughout the entire process and its modifications. The combustion chamber at its bottom has connection with the distribution duct 135, the duct terminating at the distribution plate 136' shown. The distribution plate is of such configuration that it may be effectively passed through the bed, precedent to and following operation. In the preheating of a 24" ladle, for example, the burner 130 may be fired with oil or natural gas with a maximum output of approximately 200,000 BTU per hour AR. In practice, the burner may operate at approximately 2–3 p.s.i.g. chamber pressure, nonetheless the fuel supply to the burner must be at slightly above this value where oil comprises the primary fuel supply. This requirement is well within the capability of an oil feed pump for natural gas supply. Nonetheless in the event that the natural gas supply is used, a higher pressure regulator must be employed. An air preheater 140 is desirable and where, in the normal course of the events a 24" ladle is to be preheated, the preheater may be quite small; vis: having a UA value of approximately 200 BTU per hour, F. A conduit 134" is shown herein. This provides for the direct introduction to an initially preheated fluidized-bed of a pulverized fuel such as coal or natural gas or oil to establish and maintain direct combustion with the bed, which continues to be supplied with fluidizing and combustion air through the distribution plate 136'. It is within the scope of invention not only to utilize solid fuels for this direct combustion function but also fluids such as gas and/or liquid fuels or combinations of solid and liquids as in a slurry thereof. A coal oil slurry, for example, would suffice herein. This supplemental continuum of the heating process and the FIG. 3 modification will be more fully described hereinafter.

Because of the readily available nature of sand having high temperature quality, it is desirable to be used as the fluidized material. Moreover, it is not an objectionable contaminant in the manufacture of steel and non-ferrous metals. An alternately useful particulate may be aluminum oxide.

The present combustion and fluidizing method of ladle heating circumvents prior art problems by heating the ladle with a contained, fluidized heat transfer medium. As shown, this is heated by the combustion exhaust from a burner 130 in the line connecting the blower to the fluidizing air distribution plate 136' in the ladle. Pre-heated fluidizing air, which assists in combustion function is introduced via conduit 134'. The within systems for initial ladle heat, ideally burn oil or natural gas and operate with ultimate burner exhaust temperatures of 2000°–2300° F. Alternately, final heating may be effected by the introduction of coal, gas or oil directly to the fluidized bed, following an initial heat with oil, gas or electricity of 1000° F. The fuel introduced via conduit 134" will ignote, of course, and continue to augment heating the bed to 1600°–1800° F., as required. Incidentally, this entire operation should occur just prior to charging the heated ladle with molten metal.

In practice, a ladle 110 containing the sand is first moved to a ladle heating station. Depending upon the arrangement chosen, the ladle may be either raised up, allowing the distribution plate to penetrate the sand bed or the heating system 120 may be lowered into the ladle. When air is supplied to the distribution plate 136 its design allows easy penetration of a given sand bed. Positioning of the FBLHS and the ladle is complete when the refractory cover 120 rests on the top edge of the ladle 110. At this time the blower 150 burner 130 and exhauster 160 in the FBLHS are turned on. The fuel supply (natural gas or oil) to the burner or electricity, FIG. 3 and introduction of pre-heated fluidizing air through the burner is carefully controlled to maintain the desired discharge temperature. The discharge temperature limit will thus depend upon the discharge tube and distribution plate temperature capabilities. The burner exhaust fluidizes the sand bed and subsequently heats the ladle. The cooled exhaust is directed via conduct 138 through an air preheater 140 and finally filtered at 150 before being discharged to the atmosphere. In preheating the bed, the gasses of combustion from burner 130 raise the temperature of the bed up to 800°–1000° F. Subsequent increased heating by direct combustion from the fuel entraining injector 134" is obtained by internal combustion within the bed and this is enhanced by the continued forced draft of preheated air through duct 134' and distribution plate 136'. A similar function is served by duct 134' as the FIG. 3 modification may be used.

Figure 3:
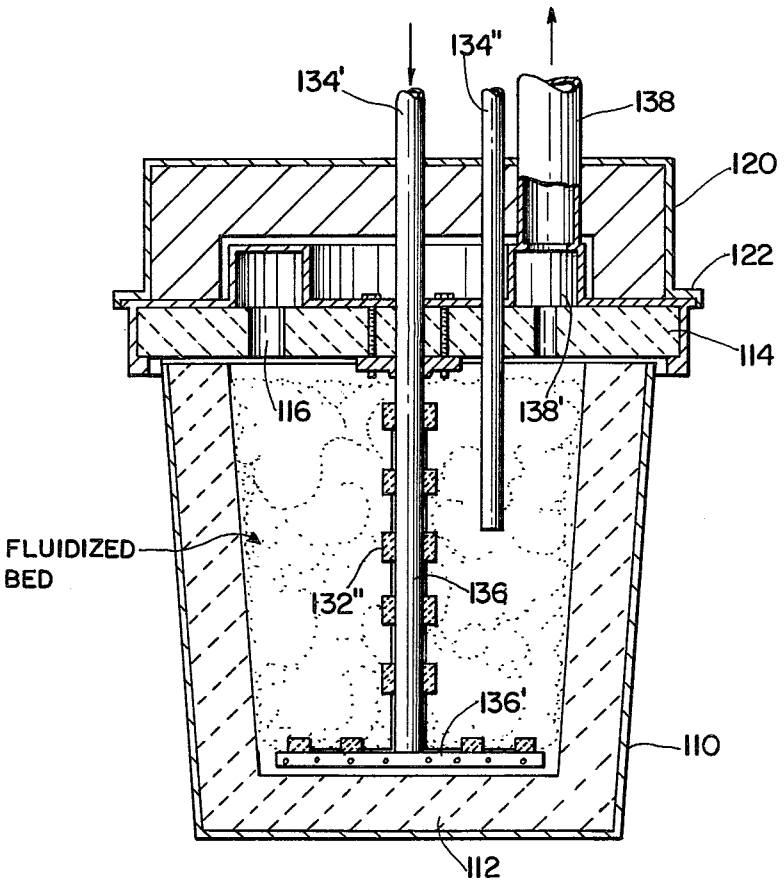
FIG. 3 is an enlarged sectional view of a modified form of invention wherein a source of electrical heat is immersed into the bed to initially raise its temperature to the point where combustion of fuel will be sustained within the bed with the fluidizing pre-heated air.

In FIG. 3, like numerals depict equivalent elements of the FBLHS. By energizing the electric heater resistors 132", one may preheat the fluidized bed electrically. Again, the bed has been and is maintained in its fluidized state by the forced draft of pre-heated air from duct 134' through the distribution plate 136. As the temperature of the bed is thus raised electrically to the range of 800°–1000° F., the electrical heater is deenergized. Simultaneously, solid or fluid fuel is injected directly into the bed via injector 134", causing instantaneous and continuous combustion therein to raise the heat of the bed to the desired high temperature range of 1600°–2000° F. During this final step of ladle preheating, the fluidization of the bed in maintained just as it was in the earlier preheating step.

The present Fluid Bed Ladle Heating System offers several advantages over conventional heating systems in waste heat recovery. Since all of the exhaust gasses are ducted in the proposed system, energy may be extracted from the stream relatively easily, using a recuperator 140 to preheat the fluidizing and combustion air passing through duct 134' on demand. The air stream leaving the recuperator is expected to be at a temperature of 500°–700° F. and this air stream might then be used for scrap metal preheating. In installations where scrap is used, the preheating would thus save energy and alleviate the problem of water and ice being dumped into the furnace with the scrap. As indicated, a significant energy savings is also obtained by immediately transferring the fluid bed media such as silicon dioxide sand from a previously heated ladle to the next ladle to be heated.

The anticipated problem of discharging fine sand particles into the surrounding air during operation will be solved by filtering the final discharge and maintaining a small negative pressure at the top of the bed. Because of irregularities in the top edge of the ladle due to slag build-ups, a complete seal between the refractory cover 114 and the ladle 110 is not practical. By having both an inlet blower 150 and exhauster 160 plus a flow control valve, not shown, a slight vacuum can be controllably maintained at the top of the ladle, causing a small influx or surrounding air, thus preventing a discharge of particulate from the bed to the surroundings at that point. This will prevent environmental and safety problems with seal leakage.

There are two primary control systems herein. The first controls a fuel supply valve not shown to maintain burner output at maximum capacity as long as fluidizing air is below a given set point temperature. Upon reaching this temperature, this first control system reduces the burner fuel supply to maintain the setpoint temperature. This system is currently commercially available and includes ignition sequencing and flame out detection. A similar first control may be adapted to the input of the desired solid or fluid fuel, directly to the fluidized bed. This control may likewise determine the output parameters of an electrical bed pre-heater such as is shown in FIG. 3. A second basic control system maintains a slight vacuum at the top of the fluidized bed. This second control comprises a control valve at the exhauster which, in turn is controlled by a pressure or flow sensing mechanism at the top of the bed. In addition to the primary first and second controls mentioned above, an interlock system is desirable to permit safe operation of the invention only if the proper starting sequence has been carried out and only if the air and fuel flow conditions are within expected limits.

Important to the invention are the following features:

(A) In the fluidizing gas distribution tube 136 and plate 136' the design must be such as to insure easy penetration into the collapsed bed, whereby to guarantee uniform fluidizing and to allow the use of the highest gas temperatures possible.

(B) The flow control systems must maintain a slight negative pressure at the top of the bed.

(C) A burner control must be introduced to allow the maximum heating rate without exceeding the temperature limit of the distribution tube and plate. Because of the combustion air preheating at 140, the burner inlet temperature will continue to rise during the ladle heating process; the discharge temperature must, therefore, be controlled. A carefully adapted flow control system is desirable to avoid entraining significant amounts of fluidized bed particulare in the air stream external to the bed.

I claim:

1. The method of high temperature heat treatment of foundry and/or mill ladles, comprising the steps of:

(A) pneumatically forming within a given ladle, a fluidized bed of refractory particles, capable of containing and sustaining high temperatures up to at least 2000° F.;

(B) heating the fluidized bed internally by injecting combustion gases therein to raise the temperature of the ladle to a range of not less than 800° F.;

(C) simultaneously with step (B) exhausting heating gases from the fluidized bed while;

(D) controlling the input of (B) with the exhaust of (C) to form a controlled zone of negative pressure above the fluidized bed.

2. The method according to claim 1 wherein the refractory particles of the fluidized bed comprise sand having a high temperature quality of up to 2000° F.

3. The method according to claim 1 wherein the refractory particles of the fluidized bed comprise aluminum oxide.

4. The method according to claim 1 wherein the refractory particles of the fluidized bed comprise sand having a high temperature quality up to 2000° F.

5. The method according to claim 1 wherein the refractory particles of the fluidized bed comprise aluminum oxide.

6. The method of high temperature heat treatment of foundry and/or mill ladles according to claim 1 wherein step (B) is conducted in two phases: a first phase of heating causing the bed to reach by external combustion, temperatures in the range of 800°-1000° F., and a second phase wherein fuel is injected into the fluidized bed to continue heating the ladle by direct and internal combustion within the fluidized bed in the ladle, supplanting first phase heating and thereby raising the temperature of the ladle to a range which is in excess of 1000° F.

7. The method according to claim 6 wherein the refractory particles forming the fluidized bed of step (A) have been preheated and transferred from a source comprising a prior heated ladle.

8. The method according to claim 6 wherein the refractory particles of the fluidized bed comprise sand having a high temperature quality up to 2000° F.

9. The method according to claim 6 wherein the refractory particles of the fluidized bed comprise aluminum oxide.

10. The method according to claim 6 wherein the fuel consumed by direct combustion within the fluidized bed comprises a solid.

11. The method according to claim 6 wherein the fuel consumed by direct combustion within the fluidized bed comprises a fluid.

12. The method according to claim 11 wherein the fuel consumed by direct combustion within the fluidized bed is a liquid.

13. The method according to claim 11 wherein the fuel consumed by direct combustion within the fluidized bed is a gas.

14. The method according to claim 6 wherein the fuel which is entrained to the bed comprises a slurry of solid and liquid fuels.

15. The method according to claim 10 wherein the solid fuel is pulverized coal.

16. The method according to claim 10 wherein the fuel effecting combustion within the fluidized bed comprises pulverized coal and a sorbent.

17. The method according to claim 16 comprising simultaneously introducing into the bed with the solid fuel and sorbent a sufficient quantity of pulverized limestone to effect desulfurization of the coal.

18. The method of high temperature heat treatment of foundry and/or mill ladles in accordance with claim 1, wherein heating the fluidized bed up to the range of 800°-1000° F. is principally effected electrically.

19. The method according to claim 18 wherein the refractory particles of the fluidized bed comprise sand having a high temperature quality up to 2000° F.

20. The method according to claim 18 wherein the refractory particles of the fluidized bed comprise aluminum oxide.

21. The method of high temperature heat treatment of foundry and/or mill ladles according to claim 18 wherein step (B) is conducted in two phases: a first phase of heating causing the bed to reach temperatures in the range of 800°-1000° F., and a second phase wherein fuel is injected into the fluidized bed to continue heating the ladle by direct and internal combustion within the fluidized bed in the ladle, supplanting first phase heating and thereby raising the temperature of the ladle to a range which is in excess of 1000° F.

22. The method according to claim 21 wherein the refractory particles of the fluidized bed comprise sand having a high temperature quality up to 2000° F.

23. The method according to claim 21 wherein the refractory particles of the fluidized bed comprise aluminum oxide.

24. The method according to claim 21 wherein the fuel effecting heat transfer to the fluidized bed by direct combustion within the fluidized bed comprises a solid.

25. The method according to claim 24 wherein the solid comprises pulverized coal.

26. The method according to claim 24 wherein the fuel effecting heat transfer to the fluidized bed by direct combustion within the bed comprises a fluid.

27. The method according to claim 24 wherein the fuel effecting heat transfer to the fluidized bed by direct combustion within the bed comprises a liquid.

28. The method according to claim 21 wherein the fuel effecting heat transfer to the fluidized bed by direct combustion within the bed comprises a gas.

29. The method according to claim 21 wherein the fuel effecting heat transfer by direct combustion within the fluidized bed comprises a slurry of solid and liquid fuels.

30. The method according to claim 25 comprising simultaneously introducing into the bed with the solid fuel a sorbent and a sufficient quantity of pulverized limestone to effect desulfurization of the coal.

31. Apparatus for the heat treatment of foundry and/or mill ladles comprising in combination with a refractory lined foundry ladle:

(A) a bed of particulate refractory within the ladle;
(B) a refractory cap removeably mounted upon the ladle, enclosing same;
(C) pneumatic means mounted upon the cap to fluidize the bed, said means extending through the cap for immersion within the bed;
(D) heating means mounted upon the cap to direct heat to the fluidized bed;
(E) fluidized bed exhaust means extending from the interior of the ladle through the cap;
(F) control means for (C) and (D) and (E) to form a controlled zone of negative pressure above the bed and to control the input temperatures of (C) relative to the exhaust temperatures of (D), thereby to allow an optimum heating rate;
(G) a source of pressurized gas for pneumatic means (C);
(H) a source of heat for heating means (D).

32. Apparatus according to claim 31, further including:

(I) a fuel injector passing through the refractory ladle cap to rest within the fluidized bed of the ladle to sustain the bed in a heated state by direct combustion therein.

33. Apparatus according to claim 31 wherein the heating means (D) comprises a fuel burner.

34. Apparatus according to claim 31 wherein the heating means (D) comprises electric heating means.

35. Apparatus according to claim 32 wherein the heating means (D) comprises a fuel burner.

36. Apparatus according to claim 32 wherein the heating means (D) comprises electric heating means.

* * * * *

Disclaimer

4,190,235.—*William C. Dell,* Washington, D.C. FLUIDIZED BED LADLE HEATING METHOD AND APPARATUS. Patent dated Feb. 26, 1980. Disclaimer filed June 6, 1983, by the assignee, *The Cadre Corp.*

Hereby enters this disclaimer to claims 1, 2, 4, 31 and 33 of said patent.

[*Official Gazette March 20, 1984.*]